US005701996A

United States Patent [19]

Goto et al.

[11] Patent Number: 5,701,996

[45] Date of Patent: Dec. 30, 1997

[54] SNAP-FASTENER BAG

[75] Inventors: Shuichi Goto, Tokyo; Kenichi Tanaka; Hiroshi Odaka, both of Himeji, all of Japan

[73] Assignee: Idemitsu Petrochemical Co., Ltd., Tokyo, Japan

[21] Appl. No.: 811,231

[22] Filed: Mar. 3, 1997

Related U.S. Application Data

[63] Continuation of Ser. No. 443,086, May 17, 1995, abandoned.

[30] Foreign Application Priority Data

May 17, 1994 [JP] Japan ..... 6-102923

[51] Int. Cl.[6] ..... B65D 85/18; B65D 30/24

[52] U.S. Cl. ..... 206/287; 383/63; 383/48; 383/100; 383/210

[58] Field of Search ..... 383/63, 48, 100, 383/210; 206/287; 229/87.15, 87.16, 87.17

[56] References Cited

U.S. PATENT DOCUMENTS

| | | | |
|---|---|---|---|
| 2,595,708 | 5/1952 | Salfisberg | 383/100 |
| 3,264,755 | 8/1966 | Moore | 206/287 |
| 3,325,083 | 6/1967 | Frye | 383/210 |
| 3,502,487 | 3/1970 | Byrd | 383/100 |
| 3,516,217 | 6/1970 | Gildersleeve | 383/100 |
| 4,084,689 | 4/1978 | Yamagata | 206/287 |
| 4,532,652 | 7/1985 | Herrington . | |
| 4,572,364 | 2/1986 | Jordan | 206/287 |
| 4,653,661 | 3/1987 | Buchner et al. | 383/103 |
| 4,708,167 | 11/1987 | Koyanagi . | |
| 4,834,554 | 5/1989 | Stetler, Jr. | 383/100 |
| 4,837,262 | 6/1989 | Jeon et al. . | |
| 5,240,112 | 8/1993 | Newburger | 383/63 |

FOREIGN PATENT DOCUMENTS

| | | | |
|---|---|---|---|
| 1068238 | 12/1979 | Canada | 383/100 |
| 1367922 | 6/1964 | France | 383/100 |
| A2695108 | 3/1994 | France . | |
| U-6608077 | 6/1971 | Germany . | |

*Primary Examiner*—Stephen P. Garbe

*Attorney, Agent, or Firm*—Flynn, Thiel, Boutell & Tanis, P.C.

[57] ABSTRACT

A snap-fastener bag according to the present invention is composed of a quadrilateral bag body, a deaerating passage provided along a bottom-seal and a snap fastener provided along the opening. The deaerating passage is provided by configurating a deaerating passage opening as a non-adhesive part through one side-seal and along the bottom-seal and by configurating an adhesive part near the bottom of the side-seal to near the other side-seal positioned at a predetermined interval from the bottom-seal in parallel to adhere between the top and bottom films. A paint film coated with a sticky substance having the kinematic-viscosity of $4–5,000\times10^{-6}m^2/s$ (100° C.) such as polybutene is applied in the deaerating passage.

14 Claims, 6 Drawing Sheets

SNAP-FASTENER BAG

This application is a continuation of U.S. Ser. No. 08/443,086, filed May 17, 1995, now abandoned.

BACKGROUND OF THE INVENTION

1. Field of the Invention

This invention relates to a snap-fastener bag and, more particularly, is available in various uses such as a quilt storage sack and a clothes bag.

2. Description of the Related Art

Several packing bags (zippered bags) which have, on an opening side thereof, a web-like snap fastener (a fixation) consisting of a male snap fastener half-member and a corresponding female snap fastener half-member capable of intermeshing each other so that the opening side of the packing bag can be shut and opened repeatedly have been used in the field of foods industry for a long while.

And recently, the packing bag has been also used as a quilt sack and clothes bag. The snap-fastener bag used for the quilt sack and clothes bag is characterized by having a snap fastener of a sealing type and by diminishing its capacity by means of deaeration. The well-known deaerating method has steps of opening a part of the snap fastener, pressuring with weight or inhaling air with a vacuum cleaner in order to remove air from the bag and closing quickly the snap fastener.

There is, however, a disadvantage to deaerating the bag in this manner. Because, although the snap fastener is closed as soon as the deaerating process completes, for the extremely short time from when the deaerating process completes to when the snap fastener is closed, air removed from the bag is inevitably reintroduced into the bag again.

Incidentally, using various nonreturn valves on the market can be scarcely regarded as reasonable in view of high cost and time to provide the nonreturn valve in the bag.

SUMMARY OF THE INVENTION

A snap-fastener bag according to the present invention is characterized by providing a deaerating passage having stickiness in a bag body.

An original shape of a snap fastener in the snap-fastener bag needs not only being limited into one shape formed by a pair of half-members intermeshing each other, but also has a known shape capable of intermeshing to each other. The snap fastener capable of connecting on each face of a female half-member and a male half-member is recommended as the snap fastener employed in the present invention to obtain fine airtightness.

Incidentally, the snap fastener may be parallely provided under the opening with more than two lines.

The number of deaerating passage is not limited into one deaerating passage but also may be over two deaerating passages provided in response to a shape or large size of the bag.

The deaerating passage can be provided in the bag body itself or on the outside of the bag body.

In the present invention, the deaerating passage maintains stickiness by a a resealant paint film made of a sticky substance.

The resealant paint film made of the sticky substance is formed by coat, print, lamination or the like.

In the present invention, the sticky substance has the recommended kinematic-viscosity of $4\times10^{-6}$ $m^2/s$ to $5{,}000\times10^{-6}$ $m^2/s$ (100° C.).

If the kinematic-viscosity is out of the above range, it will be difficult to obtain a smooth open-close action of the deaerating passage, as is the aim of the present invention. Quantity of the coated sticky substance may be defined in response to the viscosity of the sticky substance coated on the paint film in the bag.

In the present invention, the sticky substance consists of one selected from the group of polybutene, silicon oil, glycerin, edible oil, mineral oil.

In the present invention, the deaerating passage is configurated by at least one adhesive part formed between top and bottom flexible films organizing the bag body.

In the case, the deaerating passage is configurated in the bag body.

The deaerating passage may be structured by adhering a middle-film on one of the top or bottom films of the bag body.

When the open-close action of the deaerating passage is not smoothly carried out for the hard top/bottom film, the employment of a soft film as the middle-film causes the open-close action of the deaerating passage to be smooth.

In the present invention, the inside of the films organizing the whole bag body is made of a material having stickiness.

Mentioning the above material, for example, polyolefin such as polypropylene (PP), polyethylene (PE) and ethylene-vinyl-acetate copolymer (EVA), poly vinyl chloride (PVC), polyethylene terephthalate (PET) or nylon (Ny) or copolymer or denaturization thereof can be nominated.

However, the material is not limited in the above example, or it may be possible for the material to maintain the contacting state between the inside of the top and bottom films in the bag body so as to stop almost all of the flow of air in the deaerating passage when force from outside is not applied to the bag.

As stated thus, if the films themselves have stickiness, there is no necessity to coat with a sticky substance, and an appropriate contacting state of films to each other can be obtained.

According to the present invention, applying pressure to the bag with contents during the closing state of the deaerating passage, the deaerating passage is opened to remove air by high internal pressure. When the deaeration carried out by applying pressure to the bag completes, since the inside of the bag is already in a state of decompression by expansionary force of the contents, the films at the deaerating passage are naturally forced into the contacting state between the inside of the films. Therefore, the deaerating state in the bag can be maintained in the same state as the state just after completing deaeration and closing the deaerating passage. In other words, the deaerating passage according to the present invention works as a nonreturn valve capable of flowing air in one direction from the inside of the bag to the outside.

DETAILED DESCRIPTION OF THE PREFERRED EMBODIMENT(S)

Figure 1:
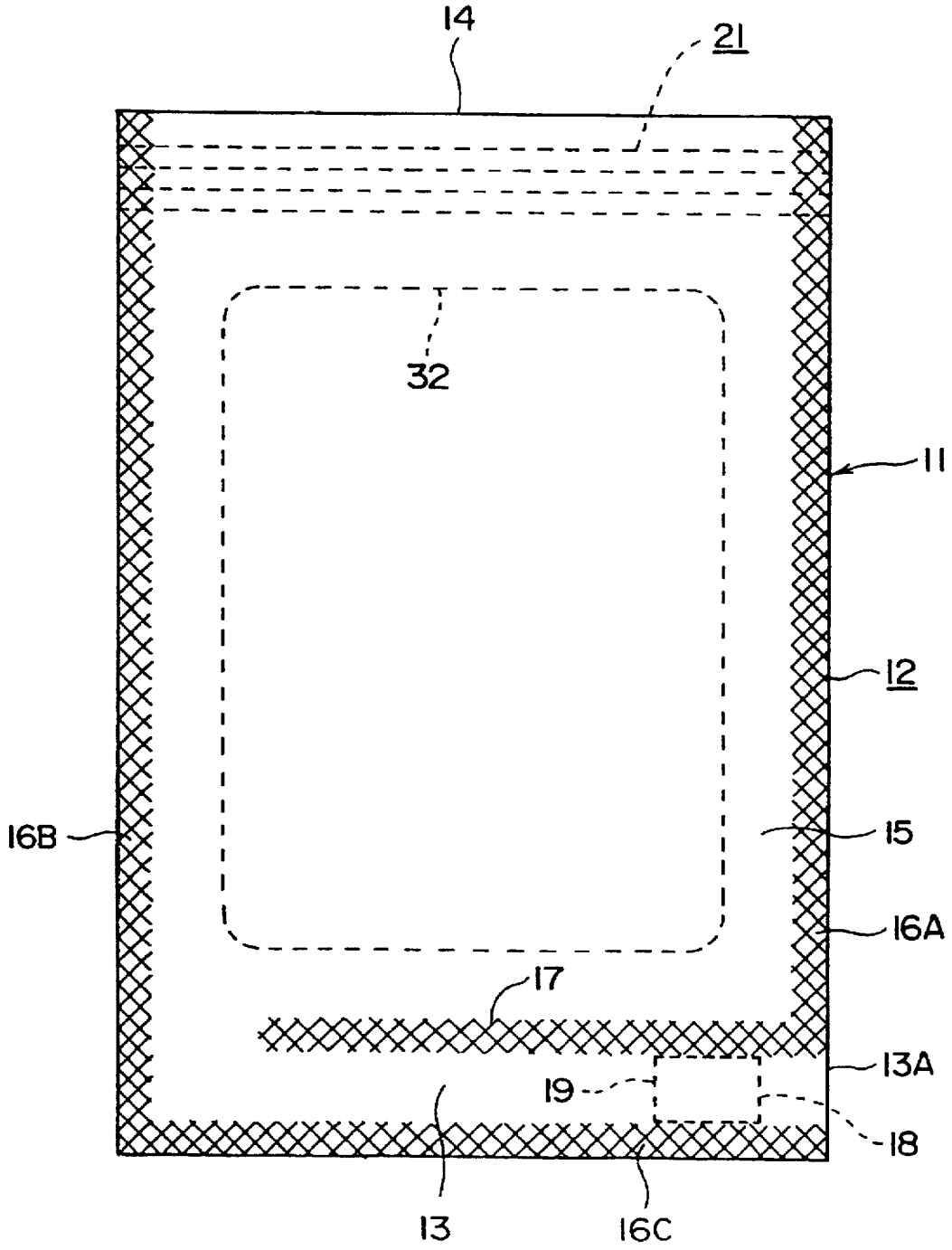
FIG. 1 is a plan view of a snap-fastener bag according to the first embodiment of the present invention.

A snap-fastener bag according to the first embodiment of the present invention will be explained with reference to FIGS. 1–5.

The snap-fastener bag 11 is composed of a bag body 12, a deaerating passage 13 provided near a bottom-seal and a snap fastener 21 provided parallel under an opening 14.

The bag body 12 has side-seals 16A, 16B and the bottom-seal 16C which are integrated by adhering the top-and-bottom surface resin flexible films 15. The resin film 15 is of a multilayer film laminated with a nylon-film as an outer side layer and a liner chain low-density polyethylene (L-LDPE) film as an inner side layer (an adhesive layer).

The deaerating passage 13 is provided by configurating a deaerating passage opening 13A as a non-adhesive part between the side-seal 16A and the bottom-seal 16C and by configurating an adhesive seal part 17 above the bottom of the side-seal 16A to the side-seal 16B at a predetermined interval from the bottom-seal 16C in parallel to adhere between the up-and-bottom flexible films 15. The predetermined interval between the bottom-seal 16C and the adhesive seal part 17 may be optionally determined to have enough space in which air passes through the deaerating passage 13 to the outside of the bag 11.

Figure 2:
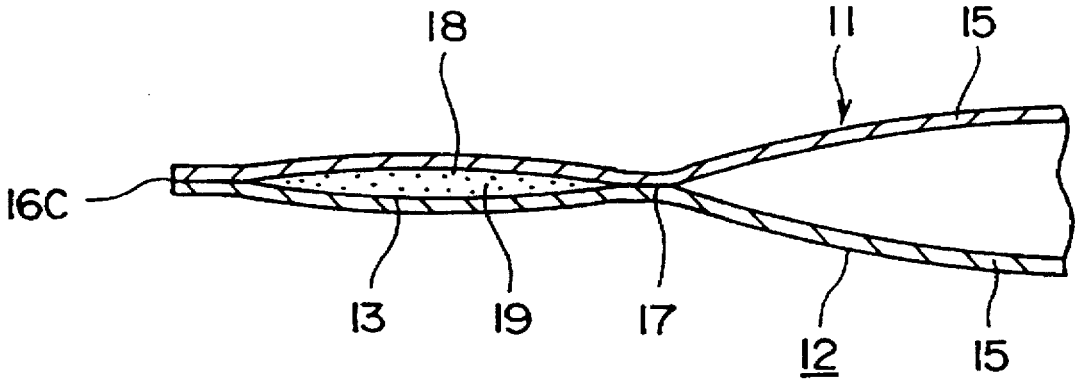
FIG. 2 is a fragmentary sectional view of the snap-fastener bag according to the first embodiment.

As shown in FIG. 2, in somewhere of the deaerating passage 13, for example, next to the deaerating passage opening 13A, a paint film 19 coated with a sticky substance 18 is formed. A specific example of the sticky substance is polybutene [the kinematic-viscosity of $8\times10^{-4}$ $m^2/s$ (100° C.)], and the sticky substance can also utilize silicon oil, glycerin, edible oil, mineral oil or the like. The coating of the passage 13 with the sticky substance 18 can be performed to the snap-fastener bag 11 having the adhesive part 17.

Figure 4:
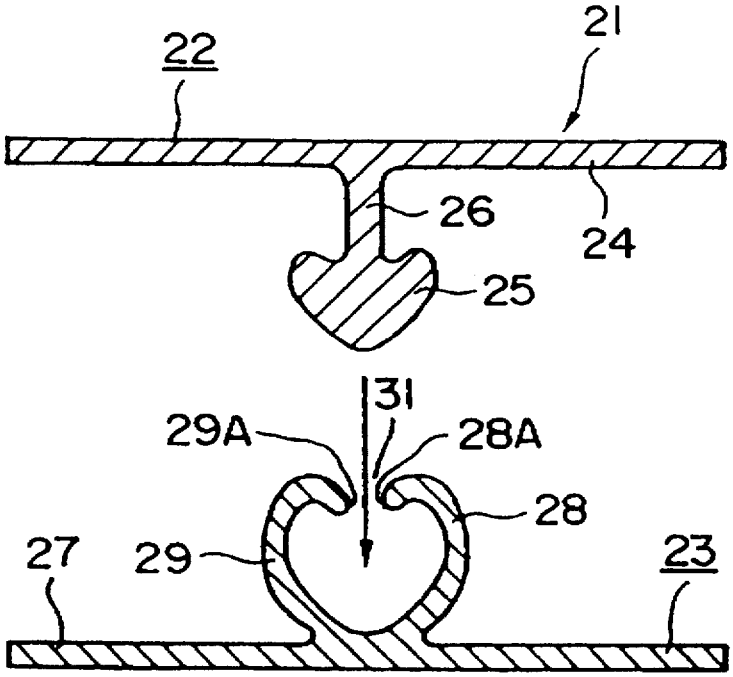
FIG. 4 is a sectional view of a snap fastener of the snap-fastener bag according to the first embodiment.
Figure 5:
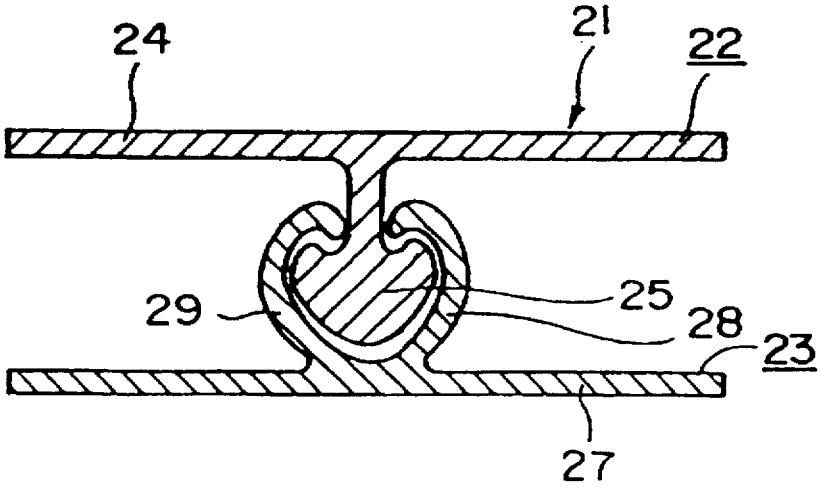
FIG. 5 is a sectional view of a snap fastener of the snap-fastener bag according to the first embodiment.

As shown in FIGS. 4 and 5, the snap fastener 21 is composed of a mating pair, a male half-member 22 and a female half-member 23, in which the male half-member 22 is adhered inside the bag on the up film 15 composing the bag body 12 and the female half-member 23 is adhered inside the bag on the bottom film 15.

The male half-member 22 is integrated with a web-like base section (a tape section) 24 as a welding portion to be welded to the bag body, a sectionally heart-shaped head section 25 and a joint section 26 to connect both sections 24 and 25 with each other. The female half-member 23 is integrated with a web-like base section (a tape section) 27 to be welded to the bag body, a semi-circular first hook 28 fixed in relation to the base section 27 and a second hook 29 symmetrical to the first hook 28. There is provided an interval 31 having about enough width for a thickness of the joint section 26 between edges 28A and 29A of both hooks 28 and 29. Since a connecting-face state of the male half-member 22 and the female half-member 23 can be obtained when the snap fastener 21 is closed, the snap fastener 21 can obtain fine airtightness.

Material of the snap fastener 21 is, for example, L-LDPE.

Now a way of using the snap-fastener bag 11 will be explained.

The snap fastener 21 is opened in order to put a contents 32 such as a quilt into the bag 11 and closed. As shown in FIG. 2, the deaerating passage 13 is still closed in the above-mentioned state.

Figure 3:
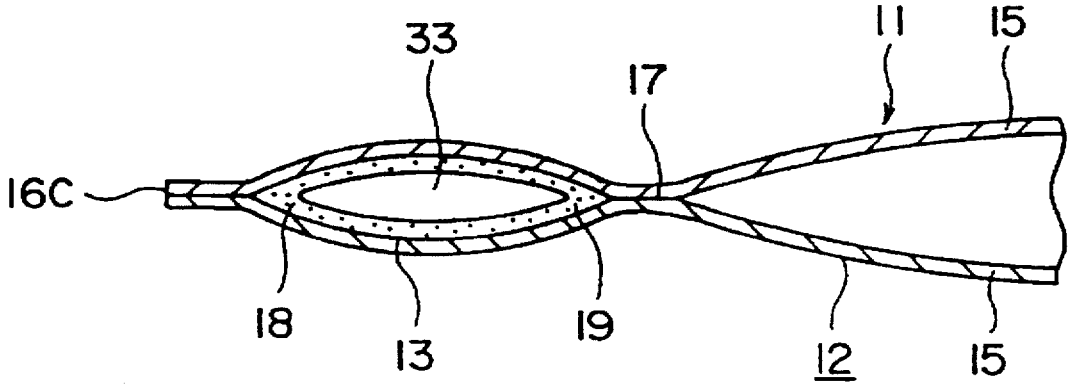
FIG. 3 is a fragmentary sectional view of the snap-fastener bag in a working state according to the first embodiment.

Next, as shown in FIG. 3, pressuring to the bag 11 with hands and so on, internal pressure of the bag 11 becomes higher, so that a deaerating hole 33 is made at the paint film 19 in the deaerating passage 13. Therefore, the deaerating passage 13 is opened to pass air therethrough to the outside of the bag 11.

Ceasing pressure to the bag 11 after air is completely deaerated from the bag 11, the paint film 19 is reconnected again because the deaerating hole 33 is closed. The bag 11 has higher negative pressure as a result of decompression by expansionary force of the contents 32.

Accordingly, a tight contacting state between the top and bottom films 15 at the deaerating passage 13 via the paint film 19 is obtained, so that air flowing from the outside of the bag through the deaerating passage 13 to the inside is obstructed in a normal state. The forcibly deaerated state of the bag 11, as stated above, is remained.

In the snap-fastener bag 11 according to the present invention, since the paint film 19, coated with the sticky substance 18 such as polybutene, is positioned in the deaerating passage 13 provided in the bag body 12, air in the bag can be easily emitted from the deaerating passage 13 to the outside of the bag during the deaerating process. Furthermore, just after deaerating, since the deaerating passage 13 is quickly and certainly closed, the deaerating state in the bag remains for a long time as it stands by cooperative action of the internal negative pressure caused by expansion of the contents 32 and the contacting state of the deaerating passage 13 via the paint film 19. Consequently, comparing with a conventional method in which the sealing state is produced by closing the bag just after deaerating or vacuuming air under condition that the snap fastener is partly opened, in the present invention, there is no concern that the resulting deaerating state is imperfect by air being reintroduced into the bag again until the bag is resealed.

The deaerating passage 13 is simply structured and easily produced by forming the adhesive seal part 17 next to the bottom-seal 16C of the bag body 12 and forming the painted film by coating it with the sticky substance 18.

And the rapid open-close action of the snap fastener, as does the conventional method, is not required because the deaerating process in the bag 11 can be carried out in the closed state of the snap fastener 21, so that the deaerating process is easily performed.

Figure 6:
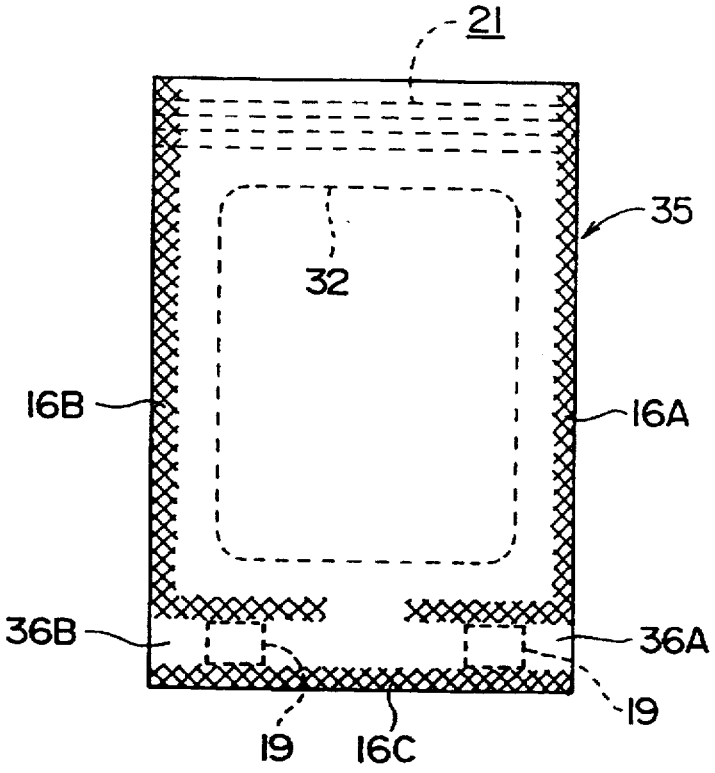
FIG. 6 is a plan view of the snap-fastener bag according to the second embodiment of the present invention.

A snap-fastener bag 35 of the second embodiment according to the present invention will be explained with reference to FIG. 6. Only one deaerating passage 13 is provided in the snap-fastener bag 11 according to the first embodiment, but the snap-fastener bag 35 of the second embodiment includes two deaerating passages 36A, 36B which are parallely provided near the bottom-seal 16C under both of the side-seals 16A, 16B like the deaerating passage 13 according to the first embodiment.

In addition to effect of the first embodiment, the above-mentioned snap-fastener 35 can shorten the deaerating time by reason of the two deaerating passages 36A, 36B which is twice as many as the first embodiment, because the width of the deaerating passages 36A, 36B has limits.

Figure 7:
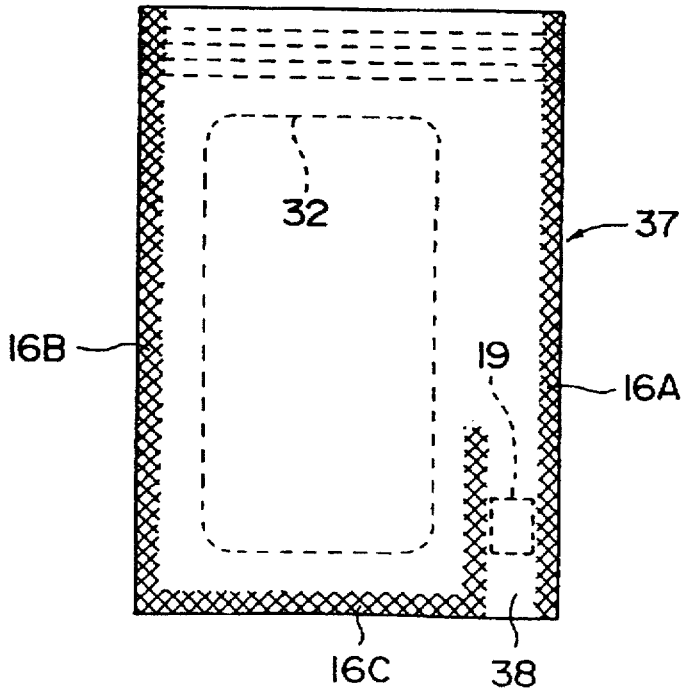
FIG. 7 is a plan view of the snap-fastener bag according to the third embodiment of the present invention.
Figure 8:
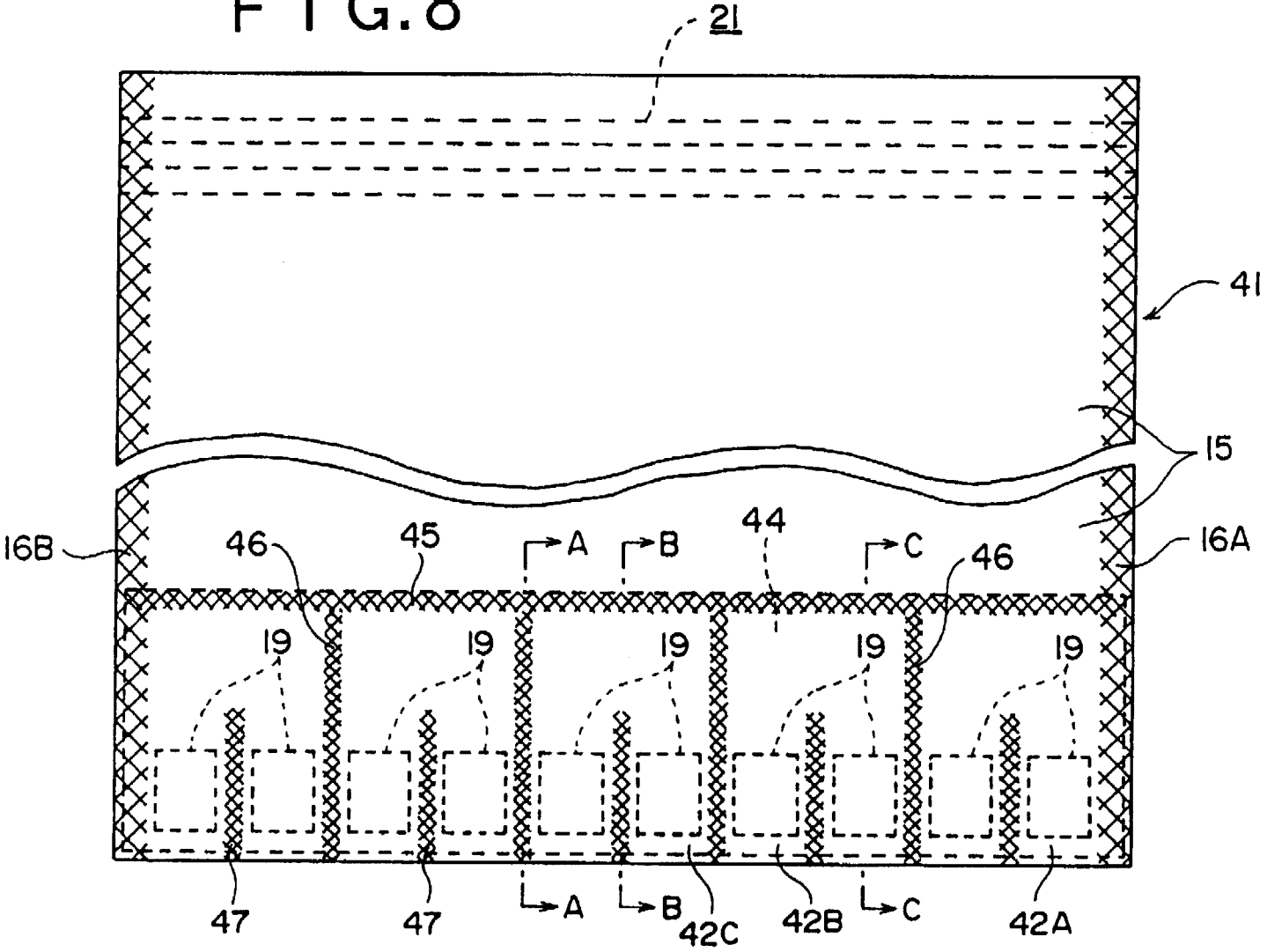
FIG. 8 is a plan view of the snap-fastener bag according to the second embodiment of the present invention.

Next, a snap-fastener bag 37 of the third embodiment according to the present invention will be explained with reference to FIG. 7. The deaerating passage 13 is parallely provided along the bottom-seal 16C in the snap-fastener bag 11 according to the first embodiment, but in the snap-fastener bag 37 the deaerating passage is parallely provided next to the side-seal 16A.

The above-mentioned snap-fastener bag 37 is convenient when the shape of contents 32 does not permit the provision of a deaerating passage 38 parallely to the bottom-seal 16C.

Lastly, a snap-fastener bag 41 of the fourth embodiment according to the present invention will be explained with reference to FIGS. 8–11.

The snap-fastener bag 41 includes plural deaerating passages 42A, 42B, 42C . . . above the bottom-seal.

The deaerating passages 42A, 42B, 42C . . . are composed of a middle-film 44 adhered at the inside of the one resin film 15 (e.g., the upper side) near a bottom opening 43 and the other resin film (e.g., the bottom side).

Figure 9:
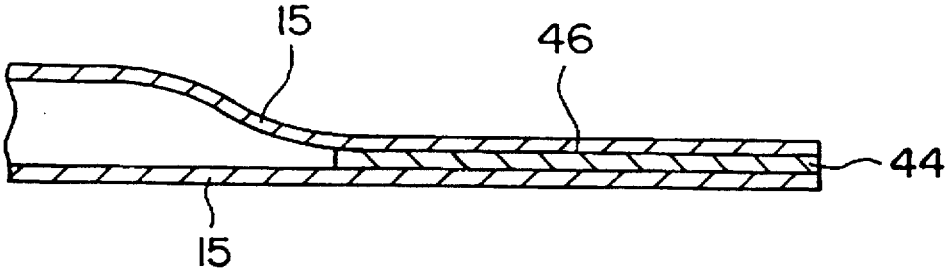
FIG. 9 is a sectional view along the A—A line in FIG. 8.

The middle-film 44 is a web-like film provided between both of the side-seals 16A and 16B, and an upper edge 44A at the side nearest the snap fastener 21 is adhered at the inside of the upper resin film 15 by a first adhesive part 45. As shown in FIG. 9, plural second adhesive parts 46 for partitioning are arranged in parallel with both of the side-seals 16A and 16B in predetermined intervals. Those second adhesive parts 46 are provided to cause the upper resin film 15, the middle-film 44 and the bottom resin film 15 to adhere together. The deaerating passages 42A, 42B, 42C . . . are configurated by the bottom resin film 15 and the middle-film 44 arranged between the second adhesive parts 46 side by side.

Figure 10:
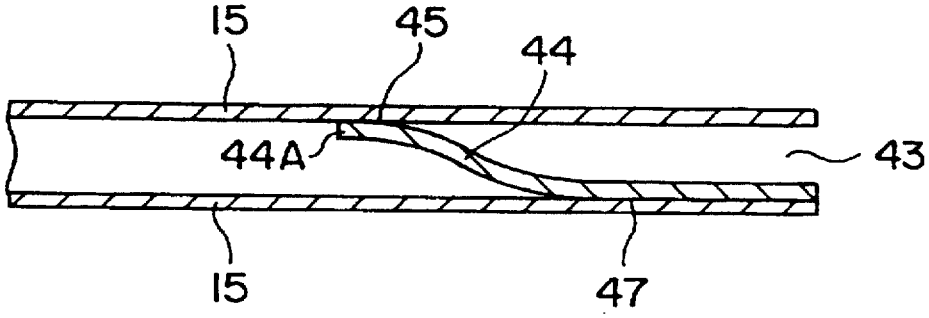
FIG. 10 is a sectional view along the B—B line in FIG. 8.

As shown in FIG. 10, from near the center to the bottom of the second adhesive parts 46, third adhesive parts 47 are arranged to adhere partly the middle-seal 44 near to the bottom opening 43 with the bottom resin film 15. The third adhesive parts 47 cause the top and bottom resin films 15 to adhere quickly to each other after completing deaeration in case where there are wide intervals between the second adhesive parts 46, so that in case of the narrow intervals between the second adhesive parts 46, there is no necessity to have the adhesive parts 47.

Figure 11:
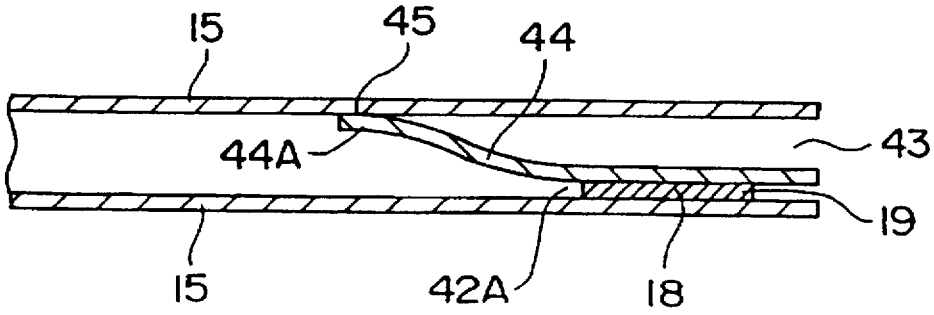
FIG. 11 is a sectional view along the C—C line in FIG. 8.

As shown in FIG. 11, the paint films 19 having the sticky substance 18 such as polybutene are formed in the deaerating passages 42A, 42B, 42C . . .

In the fourth embodiment according to the present invention, when the open-close action of the deaerating passages 42A, 42B, 42C . . . is not smoothly carried out for the hard resin film 15, the employment of the soft middle-film 44 causes the open-close action of the deaerating passages 42A, 42B, 42C . . . to be sufficiently smooth.

Since the number of deaerating passages is increased in the bag 41 to more than the bag 35 of the second embodiment, the deaerating time can be further shortened.

Air in the bag can be also be deaerated from the bag 41 by rolling from the side-seal 16A or 16B to the oppositing side.

Incidentally, in the above-stated embodiments, the coat of the sticky substance is carried out in order to obtain effective stickiness of the films in the deaerating passages because L-LDPE film is employed as the film composing the bag body lacks sufficient stickiness. However, there is no necessity to coat the film with the sticky substance, if the contacting state of the films to each other can be obtained by employing film itself having enough stickiness, such as soft vinyl chloride resin, EVA, LDPE, PP-grade, in stead of the resin film employed in the embodiments.

Furthermore, the deaerating passage is provided inside of the bag body in the above-stated embodiments, but a tube film for the deaerating passage may be provided outside of the bag connected to the bag body, which makes easy to inhale air from the bag with a vacuum cleaner.

What is claimed is:

1. A snap-fastener bag comprising a bag body having a storage space and having a deaerating passage therein, cloth goods being stored in said storage space and a resealant provided in said deaerating passage, said resealant having a kinematic-viscosity of $4\times10^{-6}m^2/s$ to $5{,}000\times10^{-6}m^2/s$ (100° C.), said resealant consisting of at least one selected from a group consisting of: polybutene, silicon oil, glycerin, edible oil, and mineral oil, said resealant being adapted to open said deaerating passage in response to a pressure increase due to a compression of said bag body, said storage space and said cloth goods in said storage space.

2. A snap-fastener bag comprising:

a bag body formed from two flexible films that are selectively sealed together around the outer perimeter thereof to form a selectively expandable storage space, said storage space having cloth goods stored therein;

a fastener assembly attached to said flexible films along opposed ends thereof for opening and closing said bag body;

a deaerating passage formed in said bag body by opposed portions of said flexible films, said deaerating passage extending from said storage space to an outside opening; and a resealant applied to opposed surfaces of said flexible films that define said deaerating passage, said resealant being located adjacent to the outside opening of said deaerating passage, said resealant forming a seal that normally closes said deaerating passage and that opens said deaerating passage in response to a pressure increase within said storage space in response to a compression of said storage space in said bag body and said cloth goods in said storage space.

3. The snap-fastener bag according to claim 2, wherein said resealant has a kinematic-viscosity of $4\times10^{-6}m^2/s$ to $5{,}000\times10^{-6}m^2/s$ (100° C.).

4. The snap-fastener bag according to claim 3, wherein said resealant consists of at least one selected from a group consisting of: polybutene, silicon oil, glycerin, edible oil and mineral oil.

5. The snap-fastener bag according to claim 2, wherein said deaerating passage is defined by a bottom seal in said bag body and a deaerating passage seal is spaced from said bottom seal.

6. The snap-fastener bag according to claim 2, wherein said deaerating passage is defined by a side seal in said bag body and a deaerating passage seal laterally spaced from said side seal.

7. The snap-fastener bag according to claim 2, further comprising multiple said deaerating passages that extend outwardly from a bottom seal of said bag body.

8. The snap-fastener bag according to claim 2, wherein said deaerating passage is a substantially linear passage.

9. The snap-fastener bag according to claim 2, wherein said resealant consists of at least one selected from polybutene, silicon oil, glycerin, edible oil, and mineral oil.

10. The snap fastener bag of claim 2, wherein said fastener assembly is located adjacent a first end of said bag body and said deaerating passage and said outside opening are formed in a second end of said bag body distal from said first end of said bag body.

11. A snap-fastener bag comprising:

a bag body formed from two side-by-side sections of flexible film, said film sections having a top edge, a bottom edge opposite said top edge, and opposed side edges, said film sections being adhered together along said bottom edges and said side edges thereof to define a storage space between said film sections, said storage space having cloth goods stored therein;

a fastener attached to said top edges of said film sections to selectively open and close said bag body to allow access to said storage space;

a deaerating passage formed in said bag body by selective adhesion of said film sections to each other, said deaerating passage extending from said storage space to a bottom or side edge of said bag body to an outside opening so as to open to the outside; and a resealant applied to opposed surfaces of said film sections that define said deaerating passage, said resealant being located adjacent the outside opening of said deaerating passage, said resealant forming a seal that normally closes said deaerated passage and that opens in response to a pressure increase due to a compression of said storage space in said bag body and cloth goods in said storage space.

12. The snap-fastener bag according to claim 11, wherein said resealant consists of at least one selected from polybutene, silicon oil, glycerin, edible oil, and mineral oil.

13. The snap fastener bag of claim 11, wherein said fastener is located adjacent a first end of said bag body and said deaerating passage is formed in a second end of said bag body distal from said first end of said bag body.

14. A snap-fastener bag according to claim 1, wherein said deaerating passage is configurated by at least one adhesive part formed between an upper film and a lower film that form the bag body.

* * * * *